US010526116B1

(12) United States Patent
Dorra et al.

(10) Patent No.: US 10,526,116 B1
(45) Date of Patent: Jan. 7, 2020

(54) PRESSURE-REDUCING BOTTLE COVER

(71) Applicant: Auto Cleaning Toilet Seat USA L.L.C, Miami, FL (US)

(72) Inventors: Maximo Dorra, Miami, FL (US); Federico Dorra, Buenos Aires (AR)

( * ) Notice: Subject to any disclaimer, the term of this patent is extended or adjusted under 35 U.S.C. 154(b) by 0 days.

(21) Appl. No.: 16/147,342

(22) Filed: Sep. 28, 2018

(51) Int. Cl.

| | |
|---|---|
| ***B65D 51/16*** | (2006.01) |
| ***B65D 47/24*** | (2006.01) |
| ***B65D 47/12*** | (2006.01) |
| ***B65D 39/00*** | (2006.01) |
| ***B65D 47/32*** | (2006.01) |

(52) U.S. Cl.
CPC ..... *B65D 51/1683* (2013.01); *B65D 39/0052* (2013.01); *B65D 47/121* (2013.01); *B65D 47/247* (2013.01); *B65D 47/32* (2013.01); *B65D 2205/00* (2013.01); *B65D 2539/003* (2013.01)

(58) Field of Classification Search
CPC ..... B65D 51/1683; B65D 47/247; B65D 47/121; B65D 47/32; B65D 39/0052; B65D 2539/003; B65D 2205/00
USPC ..... 215/228, 315, 355–364
See application file for complete search history.

(56) References Cited

U.S. PATENT DOCUMENTS

| | | | | |
|---|---|---|---|---|
| 48,341 | A * | 6/1865 | Kloenne | B65D 47/248 215/315 |
| 3,128,896 | A * | 4/1964 | Schnier | B65D 55/063 215/364 |
| 3,135,410 | A * | 6/1964 | Federighi | B65D 39/00 215/227 |
| 3,495,622 | A | 2/1970 | Rose | |
| 3,834,412 | A | 9/1974 | Fannin | |
| 4,076,142 | A | 2/1978 | Naz | |
| 4,401,226 | A * | 8/1983 | Brown | B65D 51/1683 215/250 |
| 5,184,740 | A * | 2/1993 | Mandrell, II | B65D 51/1683 215/305 |
| 5,397,024 | A * | 3/1995 | Wu | B65D 51/1683 215/309 |
| 6,260,474 | B1 | 7/2001 | Yana | |
| 6,499,618 | B1 * | 12/2002 | Leclerc | B65D 39/00 215/291 |
| 2004/0069784 | A1 | 4/2004 | Reutter | |
| 2004/0069787 | A1 | 4/2004 | Reutter | |
| 2006/0124661 | A1 | 6/2006 | Siimes | |

(Continued)

*Primary Examiner* — James N Smalley
(74) *Attorney, Agent, or Firm* — Mark C. Johnson; Johnson | Dalal

(57) ABSTRACT

The present invention relates to a cap body operable to be removably coupled to a distal end of the container in a hermetically sealed configuration, wherein the cap body includes a button or nodule cover, a cap channel defined and surrounded by the cap body, and a gas discharge port defined on an outer surface of the cap body. The cap body includes a valve assembly disposed within the cap channel and has a longitudinally biased valve stem, wherein the valve stem has a static position with the distal valve end disposed proximal to the button or nodule cover and with the valve assembly in hermetically sealed configuration with the cap body to fluidly uncouple the first channel end and the container cavity and a gas-evacuation position with the distal valve end in a depressed position to fluidly couple the container cavity, the gas discharge port, and ambient environment.

17 Claims, 9 Drawing Sheets

(56) References Cited

U.S. PATENT DOCUMENTS

| | | | | |
|---|---|---|---|---|
| 2008/0179331 | A1* | 7/2008 | Sharp | B65D 51/2835 220/521 |
| 2009/0242561 | A1* | 10/2009 | Wellman | B65D 51/2828 220/277 |
| 2010/0044377 | A1* | 2/2010 | Porter | B65D 51/2828 220/212 |
| 2011/0030810 | A1 | 2/2011 | Shellcot et al. | |
| 2011/0174642 | A1* | 7/2011 | Coon | B65D 51/2835 206/222 |
| 2014/0346134 | A1* | 11/2014 | Tixier | B65D 41/28 215/274 |

* cited by examiner

PRESSURE-REDUCING BOTTLE COVER

FIELD OF THE INVENTION

The present invention relates generally to bottle or container covers, lids, or caps, and, more particularly, relates to a gas-relieving cork removably couplable to a bottle.

BACKGROUND OF THE INVENTION

Whether it relates to soft-drinks, such as soda, or alcoholic drinks, such as champagne, many drinks are served to consumers in containers with the internal contents under a pressure greater than the ambient environment. Those of skill in the art will appreciate that there are various ways generate this pressure difference. For example, a liquid beverage housed in the container may be infused with a gas such carbon dioxide that is dissolved therein, e.g., carbonated water. When the cap is covered over container to create a substantially hermetic seal, the internal contents become pressured through release of the gas dissolved in the liquid beverage. This container pressurization has been known to cause the cap to eject from the bottle when attempting to remove the cap from the bottle. This cap or cover ejection frequently causes serious injury to either the individual opening the bottle and those surrounding said person. Additionally, the shock of the ejection also causes many users to spill the liquid beverage housed in the container.

Some known lids or caps have been developed to relieve the increased pressure within containers, i.e., bringing the internal pressure of the container toward equilibrium with the outside ambient pressure, typically approximately one bar at sea level. One known device includes a rubber-based member that includes two annular rings or flanges lodged into a distal end of the container, wherein a lower ring includes one or more apertures formed thereon. When the user removes the device, the gas slowly escapes from the inside of the container through the apertures to relieve the internal pressure of the container. Problematically, however, many users remove the device too quickly, which does not give time for the internal pressure of the container to reach equilibrium. Additionally, these devices are also known to become dislodged before use, e.g., during transportation.

Therefore, a need exists to overcome the problems with the prior art as discussed above.

SUMMARY OF THE INVENTION

The invention provides a pressure-reducing bottle cap that overcomes the hereinafore-mentioned disadvantages of the heretofore-known devices and methods of this general type and that efficiently, effectively, and safely reduces internal container pressure before a user removes the cap directly coupled thereto.

With the foregoing and other objects in view, there is provided, in accordance with the invention and in combination with a portable and hand-held container having a bottom wall, sidewalls, a container cavity defined by the bottom wall and sidewalls, and a distal end defining a distal opening in fluid communication with the container cavity, an improvement that includes a cap body and valve assembly disposed therein. Specifically, a cap body is removably coupled to the distal end of the container in a hermetically sealed configuration and includes a button disposed on the cap body and has a lower surface. The cap body includes a cap channel defined and surrounded by the cap body, wherein the cap channel has a first channel end and a second channel end opposing the first channel end and includes a gas discharge port defined on an outer surface of the cap body and in fluid communication with the first channel end. The valve assembly is disposed within the cap channel and has a valve stem with a distal valve end and a spring operably configured to bias the valve stem in a direction toward the lower surface of the button. The valve stem has a static position along a stem translation path with the distal valve end disposed proximal to the lower surface of the button and with the valve assembly in hermetically sealed configuration with the cap body to fluidly uncouple the first channel end and the container cavity. The valve stem also includes a gas-evacuation position along the stem translation path with the button in a depressed position directly coupled to the distal valve end to fluidly couple the first channel, the container cavity, and the gas discharge port.

In other embodiments of the present invention, the cap body is removably coupled to the distal end of the container in a hermetically sealed configuration with a muselet retaining a muselet cap, defining a muselet cap aperture, coupled to the cap body. The cap body has a rigid nodule cover disposed within the muselet cap aperture and selectively removably coupled to the cap body. The cap channel is defined and surrounded by the cap body and has a first channel end and a second channel end opposing the first channel end, wherein the valve assembly is disposed within the cap channel and has a valve stem with a distal valve end and a spring operably configured to bias the valve stem in a direction toward the nodule cover. The valve stem has a static position along a stem translation path with the valve assembly in hermetically sealed configuration with the cap body to fluidly uncouple the first channel end and the container cavity and a gas-evacuation position along the stem translation path with the nodule cover selectively uncoupled from the cap body and with the distal valve end in a depressed position to fluidly couple the first channel end, the container cavity, and an ambient environment.

In accordance with another feature, an embodiment of the present invention includes the cap body also having a first end, a second end opposite the first end of the cap body, and a cap length spanning from the first end of the cap body to the second end of the cap body, wherein the button is disposed at the first end of the cap body.

In accordance with yet another feature, an embodiment of the present invention also includes the valve assembly having a valve shoulder disposed at an end of the valve stem and having an outer surface, the outer surface of the valve shoulder seated in a hermetically sealed configuration with the second end of the cap body when the valve stem is in the static position along the stem translation path.

In accordance with an additional feature, an embodiment of the present invention also includes the valve shoulder having a first diameter greater in length than a diameter of the second channel end, a second diameter less in length than the diameter of the second channel end, and a shoulder length separating the first and second diameters, wherein the valve shoulder of a uniform tapered width, i.e., having a linear slope, spanning the shoulder length. In some embodiments, the valve shoulder is of a conical shape and the second end of the cap body is of a conical shape conforming to the conical shape of the valve shoulder.

In accordance with a further feature of the present invention, the button is disposed at the terminal upper end of the cap body.

In accordance with another embodiment of the present invention, a pressure-reducing bottle cover is disclosed that includes a cap body operably configured to removably couple with a distal end of an enclosed container in a hermetically sealed configuration, wherein the cap body includes a first end, a second end opposite the first end of the cap body, and a cap length spanning from the first end of the cap body to the second end of the cap body. The cap body also includes a button disposed at the first end of the cap body and with a lower surface, a cap channel defined and surrounded by the cap body, wherein the cap channel having a first channel end and a second channel end opposing the first channel end, and includes a gas discharge port defined on an outer surface of the cap body and in fluid communication with the first channel end. The assembly also includes a valve assembly disposed within the cap channel, wherein the valve assembly has a valve stem having a distal valve end and a spring operably configured to bias the valve stem in a direction toward the lower surface of the button. The valve stem includes a static position along a stem translation path with the distal valve end disposed proximal to the lower surface of the button and with the valve assembly in hermetically sealed configuration with the cap body to fluidly uncouple the first channel end and the second channel end. The valve stem also includes a gas-evacuation position along the stem translation path with the button in a depressed position directly coupled to the distal valve end to fluidly couple the first and second channel ends and the gas discharge port.

In accordance with a further feature of the present invention, the button is of a deformably flexible material and defines a perimeter recess surrounding the button.

In accordance with the present invention, a method of relieving gas within an internal cavity of a container is disclosed that includes directly coupling an outer surface of a cap body to an internal surface of a distal end of the container to hermetically seal the internal cavity of the container from the ambient environment, wherein the cap body has a button disposed thereon, a gas discharge port disposed above the distal end of the container, and defines and encloses a cap channel with a valve assembly disposed therein and hermetically sealing a portion of the cap cannel with the internal cavity of the container. The method also includes depressing an upper surface of the button until a lower surface of the button reaches and longitudinal translates a distal end of a longitudinally biased valve stem in a stem translation path to fluidly couple the first channel, the container cavity, and the gas discharge port together, thereby discharging a gas housed within the container cavity. The method also includes removing the cap body to expose a distal opening of the container defined by the distal end of the container, e.g., for drinking or pouring by the user/consumer.

Another method relieving internal gas within a container includes the steps of providing a container with a cap body directly coupled, through an outer surface of the cap body, to an internal surface of a distal end of the container to hermetically seal an internal cavity of the container from an ambient environment, wherein the cap body defines and encloses a cap channel with a valve assembly, including a longitudinally biased valve stem with a distal end, disposed therein and hermetically sealing a first channel end of the cap channel with an internal cavity of the container. The process also includes providing rigid nodule cover selectively removably coupled to the cap body and superimposing the first channel end of the cap channel and providing a muselet, having a muselet cap defining a muselet cap aperture, and a wrapper superimposing a portion of the cap body, the muselet cap aperture, and the rigid nodule cover. The process also includes removing a portion of the wrapper and the rigid nodule cover from the cap body to expose the first channel end of the cap channel and the distal end of the valve stem and then depressing and longitudinal translating the distal end of the longitudinally biased valve stem in a stem translation path to fluidly couple the first channel end, the container cavity, and the ambient environment, thereby discharging a gas housed within the container cavity. Lastly, the process may include removing the cap body to expose a distal opening of the container defined by the distal end of the container.

In accordance with another feature, an embodiment of the present invention includes directly and deformably coupling the outer surface of the cap body to the internal surface the distal end of the container.

In accordance with yet another feature, an embodiment of the present invention also includes depressing the upper surface of the button in a parallel, axial, and longitudinal direction opposite a biasing force direction of the longitudinally biased valve stem.

Although the invention is illustrated and described herein as embodied in a pressure-reducing bottle cover, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the container and/or insertion direction of the inventive cover with respect to the container.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 2:
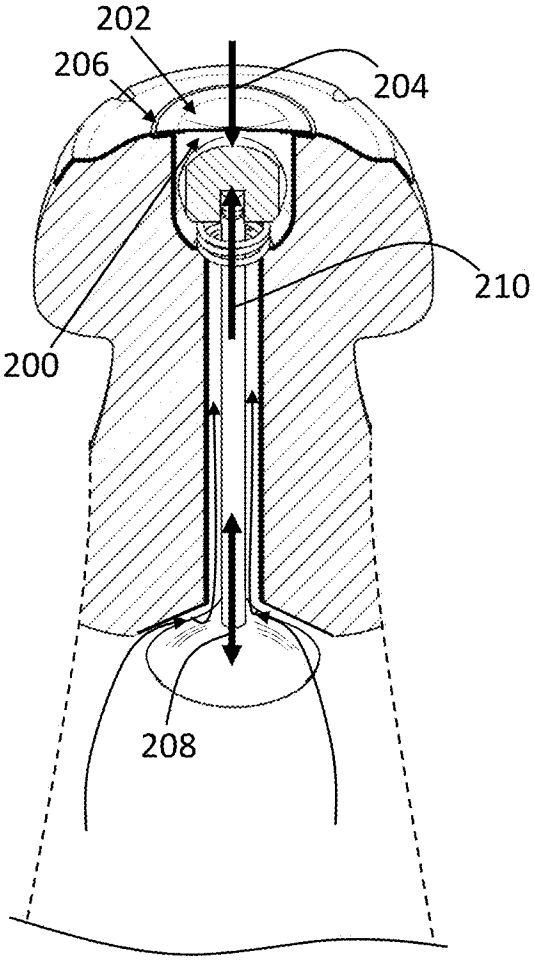
FIG. 2 is a fragmentary cross-sectional view of the pressure-reducing bottle cover in FIG. 1 in an exemplary gas-evacuation position.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Figure 1:
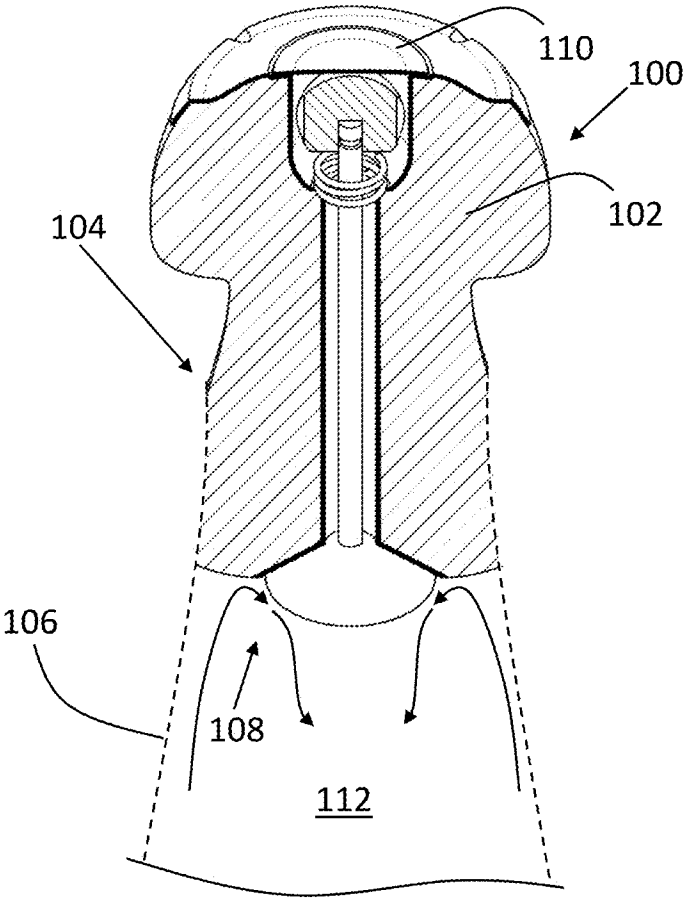
FIG. 1 is a fragmentary cross-sectional view of a pressure-reducing bottle cover coupled to a container in a static position, in accordance with one embodiment of the present invention.

The present invention provides a novel and efficient a pressure-reducing bottle cover that is operably configured to safely and effectively discharge accumulated gas within a container before the cover or cap is removed by the user. Referring now to FIGS. 1-2, one embodiment of the present invention is shown in cross-sectional views. The figures herein show several advantageous features of the present invention, but, as will be described below, the invention can be provided in several shapes, sizes, combinations of features and components, and varying numbers and functions of the components. The first example of a pressure-reducing bottle cover 100, as shown in FIG. 1, includes a cap body 102 removably coupled to the distal end 104 of the container 106 in a hermetically sealed configuration, i.e., preventing gases (represented with arrows 108 in FIGS. 1-2) housed within the container 106 from unintentionally escaping. In one embodiment, the container 106 may be bottle, e.g., a sparkling wine bottle, and the cap or cover body 102 may be sparkling wine cover of a cork material.

Figure 3:
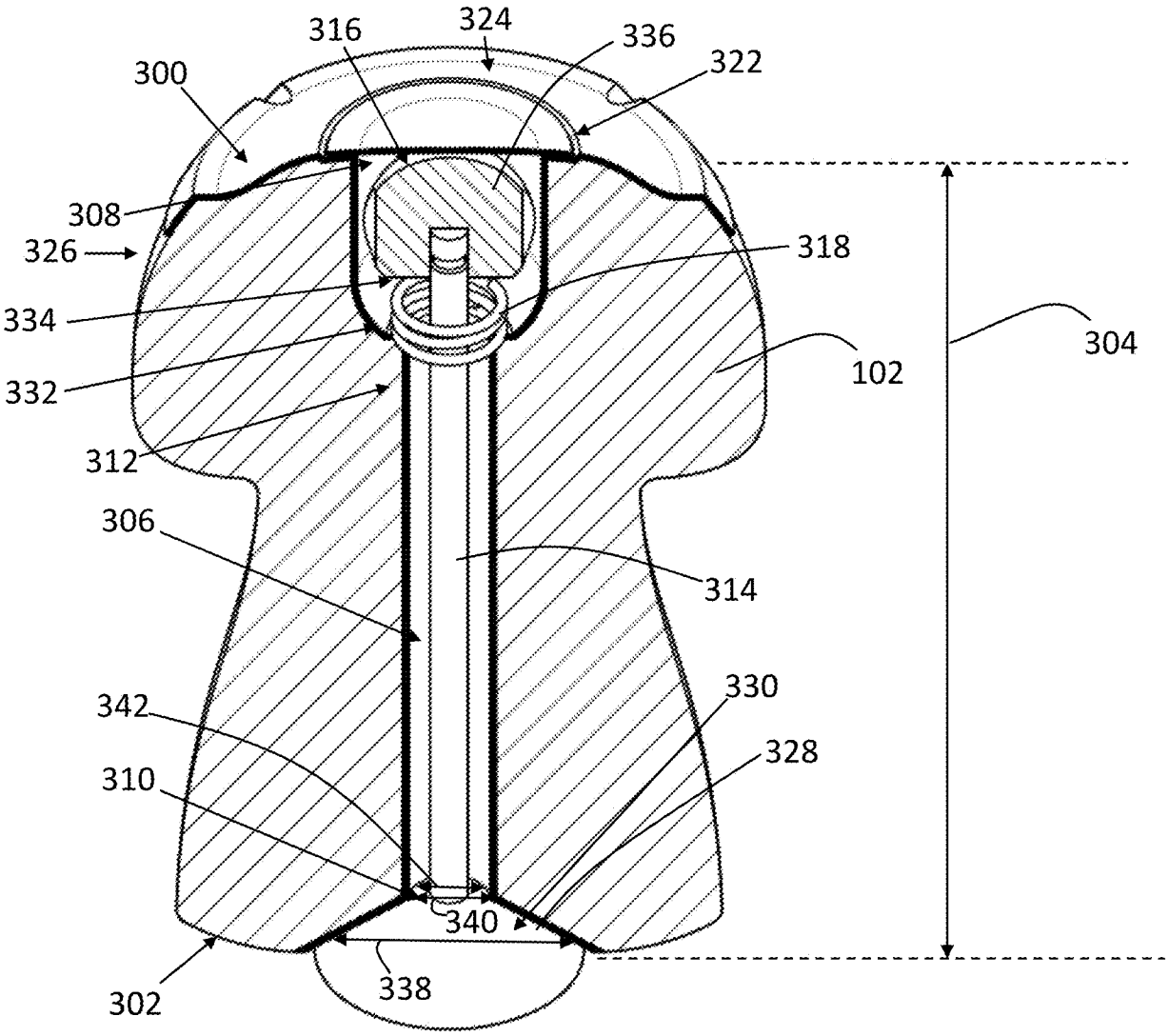
FIG. 3 is a cross-sectional view of a pressure-reducing bottle cover in accordance with one embodiment of the present invention.
Figure 5:
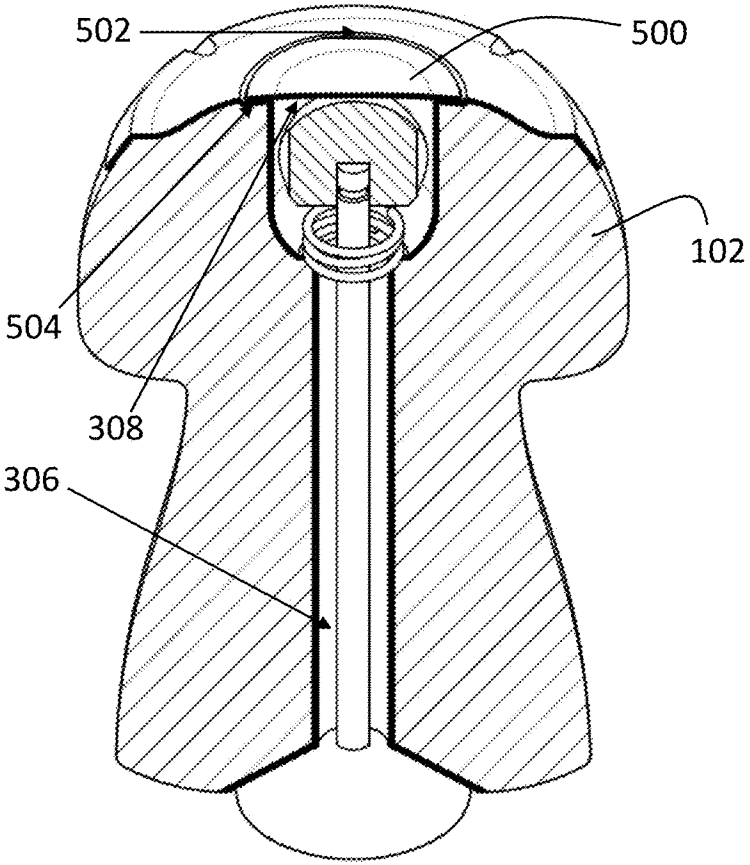
FIG. 5 is a fragmentary cross-sectional view of a pressure-reducing bottle cover in accordance with another embodiment of the present invention.

With brief reference now in conjunction with FIGS. 3 and 5, the cap body 102 may include a first end 300, a second end 302 opposite the first end 300 of the cap body 102, and a cap length 304 spanning from the first end 300 to the second end 302. Beneficially, a button 110 or nodule cover 500 can be seen disposed at the first end 300 of the cap body 102. In one embodiment, the button 110 is disposed at the terminal end of the body 102 (as shown in FIGS. 1-2) where a user can effectively and efficiently apply pressure to depress the button 110. In one embodiment, the body 102 and button 110 are of a polymeric material that are deformably resilient, e.g., natural rubber having a shore A hardness of approximately 20-50. The button 110 may be formed through an overmold manufacturing process that may define a recess 206 spanning a perimeter of the button 110, thereby enabling a more efficacious translation/deformation of the button 110. The button 110 also includes a lower surface 200, opposing an upper surface 202 where a user applies a force (represented with arrow 204) to translate/deform the button 110. In other embodiments, the nodule cover 500 is also disposed at the terminal end of the body 102 (as shown in FIG. 5), may be relatively planar or plate-like, shaped like a disc, and is of a substantially rigid (also referred to herein as "rigid") polymeric material, e.g., PVC having a shore A hardness greater than approximately 80. The nodule cover 500 beneficially prevents inadvertent depression of the stem displacement nodule 336 when, for example, the bottle or other container is in transport. Said another way, the nodule cover 500 may be inflexible under forces greater than or equal to approximately 1-2 lbf. The button 110 and cover 500 also includes a lower surface 200, opposing an upper surface 202. When used as a button 110, the user applies a force (represented with arrow 204) to translate/deform the button 110.

Still briefly referring to FIG. 3 in conjunction with FIGS. 1-2, the cap body 102 defines and surrounds a cap channel 306 defined and surrounded by the cap body 102. The cap channel 306 has a first channel end 308 and a second channel end 310 opposing the first channel end 308. Separating the first and second channel ends 308, 310 may be a channel length, wherein the channel length may substantially span, i.e., greater than 75% of or approximately equal to, body length 304. The channel 306 has a valve assembly 312 disposed within the cap channel 306, wherein the valve assembly 312 includes a valve stem 314 with a distal valve end 316. The valve assembly 312 includes a spring 318 operably configured to bias the valve stem 314 in a direction toward the lower surface 200 of the button 110. In one embodiment, the spring 318 is a compression spring of a stainless-steel material with a spring constant of approximately 55-75 lbf/in. The spring 318 may be seated within the channel 306 to bias the distal end 316 of the valve stem 314 proximal to, i.e., at or near, the lower surface 200 of the button 110.

In one embodiment, the valve stem 314 of the valve assembly 312 may include a valve shoulder 328 disposed at an end of the valve stem 314 generally opposing the distal end 316, but positioned proximal to the second channel end 310. More specifically, the valve shoulder 328 includes an outer surface 330 operably configured to be seated in a hermetically sealed configuration with the second end 302 of the cap body 102 when the valve stem 314 is in a static position (shown best in FIG. 3) along the stem translation path 208, i.e., with the biasing force of the spring 318, via the geometric constraints of an internal shoulder 332 of the body 102 and a lower end 334 of the stem displacement nodule 336. In one embodiment, the valve shoulder 328 includes a first diameter, e.g., diameter 338 of approximately 0.5 inches, greater in length than a diameter, e.g., diameter 340 of approximately 0.2 inches, of the second channel end 310 and a second diameter, e.g., diameter 342 of approximately 0.15 inches, less in length than the diameter of the second channel end 310. In one embodiment, a shoulder length separates the first and second diameters 338, 342, wherein the valve shoulder 328 is of a uniform tapered width spanning the shoulder length. Said differently, the valve shoulder 328 may also be of a conical shape, or of another shape with a geometric configuration operable to create a hermetic seal with the second end 302 and second channel end 310. In one embodiment, the second end 302 of the cap body 102 is also beneficially of a conical shape conforming to the conical shape of the valve shoulder 328 to effectuate a tighter seal when the stem 314 is in the static position. In one embodiment of the present invention the outer surface 330 of the shoulder 328 may be of a deformably resilient material, e.g., natural rubber, to effectuate a tight and/or hermetic seal. In other embodiments, the outer surface 330 of the shoulder 328 may be of a substantially rigid material, e.g., stainless steel, PVC, etc., and include a rubber gasket disposed thereon.

Figure 4:
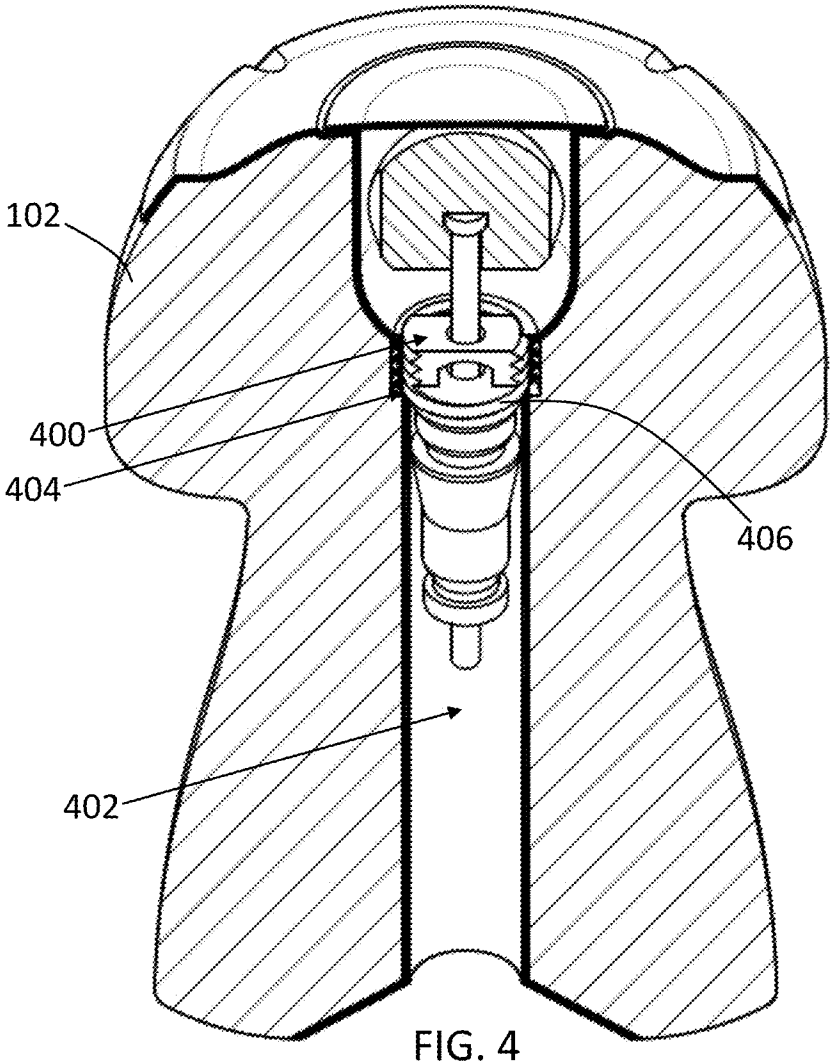
FIG. 4 is a cross-sectional view of a pressure-reducing bottle cover in accordance with another embodiment of the present invention.

In another embodiment of the present invention, a valve assembly 400 as depicted in FIG. 4 may be employed. In this embodiment, the valve assembly 400 is disposed within a cap channel 402 and lockably retained in a position through use of a corresponding threaded configuration between the body 102 of the cap and the valve assembly 400. In one embodiment, a portion 404 along a length of the valve assembly 400 may include a gasket 406 to hermetically seal and seat the valve assembly 400 within the cap channel 402. In other embodiments, the threaded configuration may provide the hermetic seal.

The body 102 also includes one or more gas discharge ports, e.g., ports 320, 322, defined on an outer surface 324 of the cap body 102. The gas discharge port(s) 320 is in fluid communication with the first channel end 308 to provide an exit for the accumulated gas 108 within an internal cavity 112 of the container 106 when the stem 314 is a gas-evacuation position (shown best depicted in FIG. 2) along a stem translation path (represented with arrow 208 in FIG. 2). In one embodiment, the gas translation path 208 is linear. In another embodiment, the gas translation path 208 is curvilinear. In one embodiment, the gas discharge port(s) 320 are of a plurality of ports disposed in the recess 206 spanning the perimeter of the button 110 so that the user can effectively feel the discharged gas downstream of the internal cavity 112 as it passed through the cap channel 306 and through the gas discharge port(s) 322. The gas discharge port(s) 322 may be of circular shape having a diameter of approximately 10-15 mils, but may be outside of said range and of another shape in other embodiments. Additionally, the gas discharge port(s) 322 may be disposed on a side surface 326 of the body 102, but at a location above the distal end 104 the container 106 when the cap body 102 is coupled to the container 106.

With reference to FIGS. 5-7 and FIGS. 9-14, the nodule cover 500 may seat on the first end 300 of the cap body 102 through, for example, a recess and platform 1300 (shown best in FIG. 13) formed on the first end 300 of the body 102. Said another way, the recess 504 and platform 1300 on the first end 300 is shaped and sized to receive and support the nodule cover 500. In one embodiment, the platform 1300 may continuously span and support the nodule cover 500, while in other embodiments it may discontinuously span and support the nodule cover 500. In some embodiments, the nodule cover 500 may also include an adhesive disposed at the bottom of the nodule cover 500.

Figure 6:
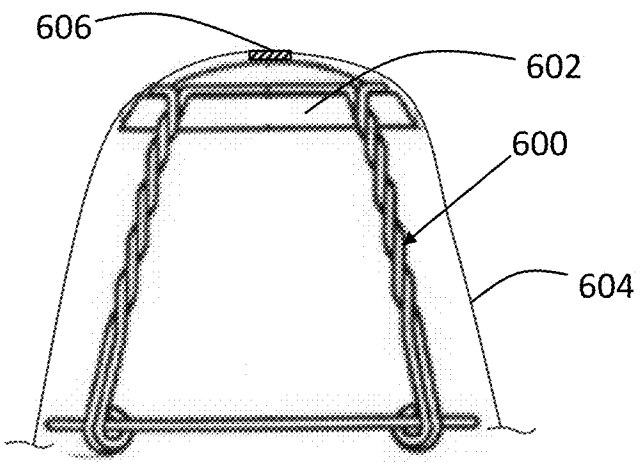
FIG. 6 is a fragmentary elevational view of a wrapper and wire-cover retaining assembly in accordance with one embodiment of the present invention.
Figure 7:
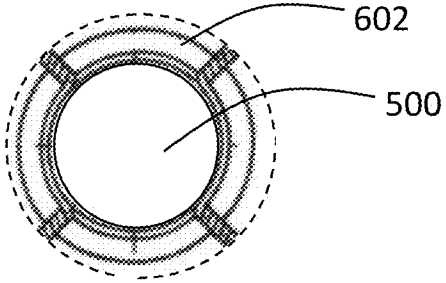
FIG. 7 is a fragmentary top plan view of the wire-cover retaining assembly of FIG. 6 with the wrapper removed.
Figure 9:
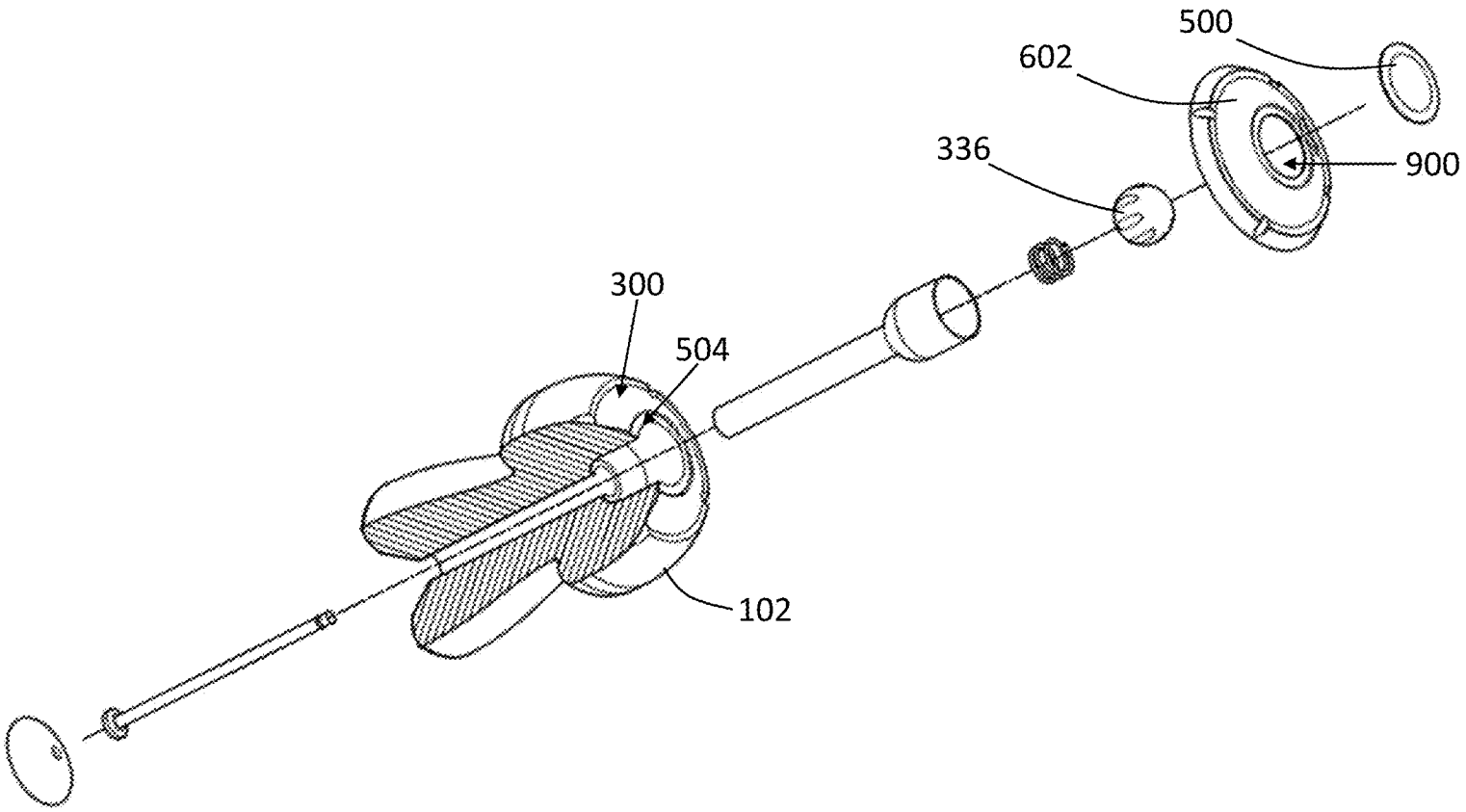
FIG. 9 depicts an exploded view of the pressure-reducing bottle cover of FIG. 5.
Figure 12:
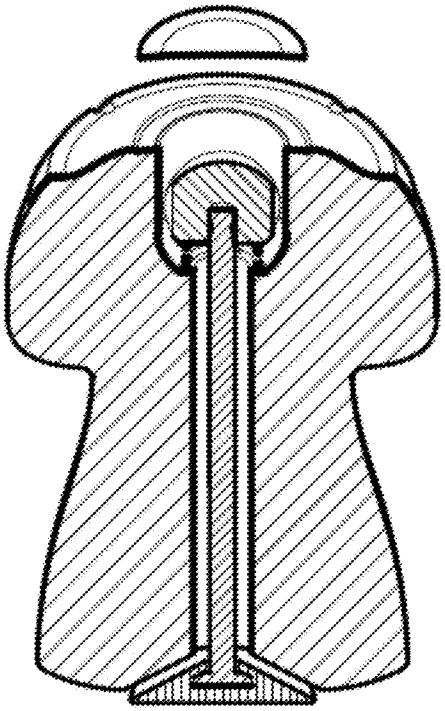
FIG. 12 depicts another cross-sectional view of the pressure-reducing bottle cover of FIG. 5 with the cover in a removed position.
Figure 11:
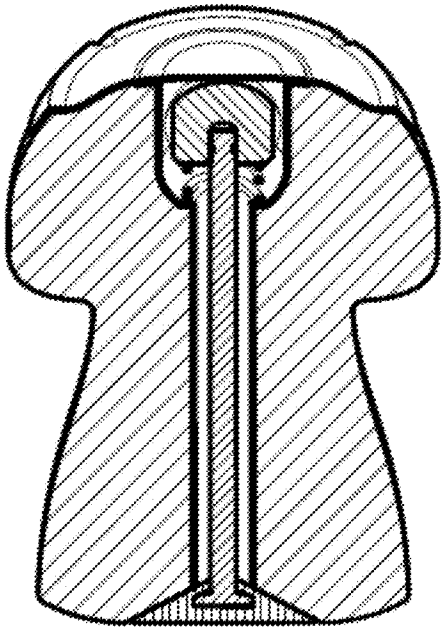
FIG. 11 depicts another cross-sectional view of the pressure-reducing bottle cover of FIG. 5.
Figure 10:
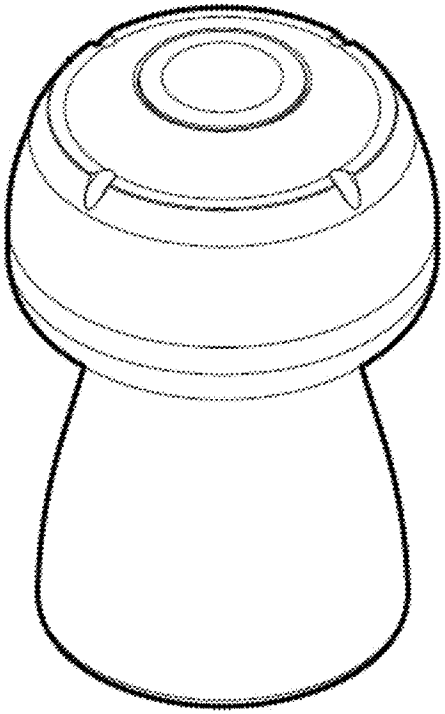
FIG. 10 depicts a perspective view of the pressure-reducing bottle cover of FIG. 5.
Figure 14:
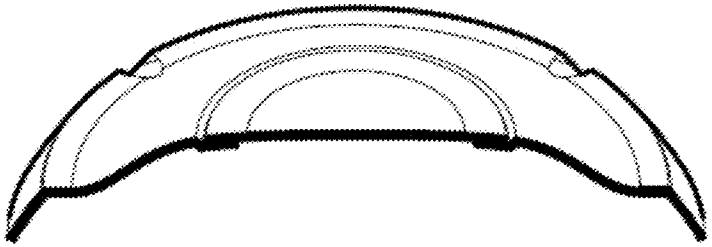
FIG. 14 depicts a fragmentary close-up view of the pressure-reducing bottle cover of FIG. 5 with the cover in a closed position.
Figure 13:
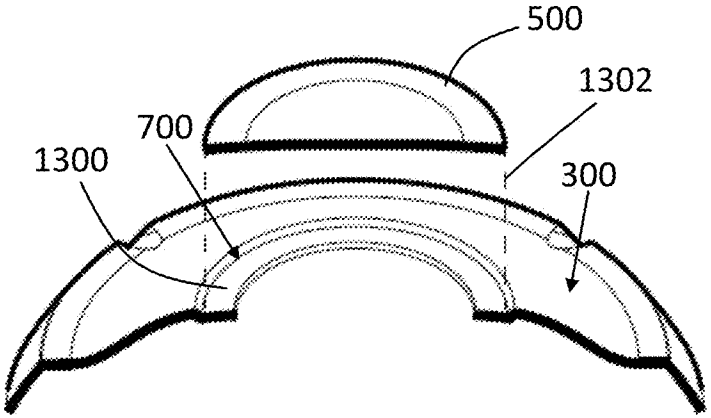
FIG. 13 depicts a fragmentary close-up view of the pressure-reducing bottle cover of FIG. 5 with the cover in the removed position.

As specifically seen in FIGS. 6-7, the wire-cover assembly or "muselet" 600, a wire cage assembly that also includes a muselet cap 602 defining a muselet cap aperture 900, are operably configured to cover and/or retain the cork, thereby preventing inadvertent emission or dislodging. The cap aperture 900 is best shown in FIG. 9 and is shaped and sized to permit entry and egress of the nodule cover 500, i.e., it has a geometry and/or dimensions greater than the geometry and/or dimensions of the nodule cover 500. In one embodiment, the nodule cover 500 is circular and has a diameter that is approximately 0.5 inches, wherein the cap aperture 900 is also circular and is approximately 0.6 inches. In other embodiments, the shape and sizing may vary. The cap aperture 900 may also conform or correspond to the shape of the nodule cover 500. While in transport and before use, the muselet 600 and nodule cover 500 may be surrounded and/or retained by a wrapper 604, which may be of a metallic foil or other deformable material. The nodule cover 500 may also be height when seated in and flush configuration in and with the top of the cap body 102 such that it does not exceed the height of the cap 602.

Therefore, in one embodiment when in the container is desired to be used, the user may remove all or a portion of the foil wrapper 604, thereby exposing the nodule cover 500 for removal by the user. Said another way, the nodule cover 500 is selectively removably coupled to the top of the cap body 102 when the wrapper 604 is in a removed position along a wrapper removal path. In another embodiment, as best shown in FIG. 6, the wrapper 604 may be coupled to a portion of the rigid nodule 500 through use of a fastener 606, e.g., adhesive. As such, when the user desires to open the container and removes the wrapper 604, the rigid module cover 500 will also be removed simultaneously. The recess 504 defined by the first end 300 of the cap body 102 facilitates in supporting the nodule cover 500. Said another way, the recess 504 provides room for the nodule cover 500 to seat on top of the cap body 102. In one embodiment, the sidewalls of the cap body 102 defining the recess 504 prevent lateral movement of the nodule cover 500 when inserted therein. The muselet cap aperture 900 and recess 504 may be shaped and sized to permit entry and egress of the nodule cover 500 through the same when the wrapper 604 is removed. When seated in the cap body 102, the lower surface 200 of the nodule cover 500 may be disposed proximal to, i.e., at or preferably near (within 1 inch), the stem displacement nodule 336. The nodule cover 500 may include an indentation 502, approximately 0.25-0.75 inches in length, that may allow a user to effectively and quickly remove the nodule cover 500 with his or her fingernail and when not fastened to the wrapper 604. When the nodule cover 500 is removed, the muselet 600 and muselet cap 602 are still coupled to and/or retaining the cap body 102 to the container 106, but the stem displacement nodule 336 and the first channel end 308 of the cap channel 306 are exposed for releasing of the gases within the container, i.e., by placing the valve assembly 312 in a gas-evacuation position.

Figure 8:
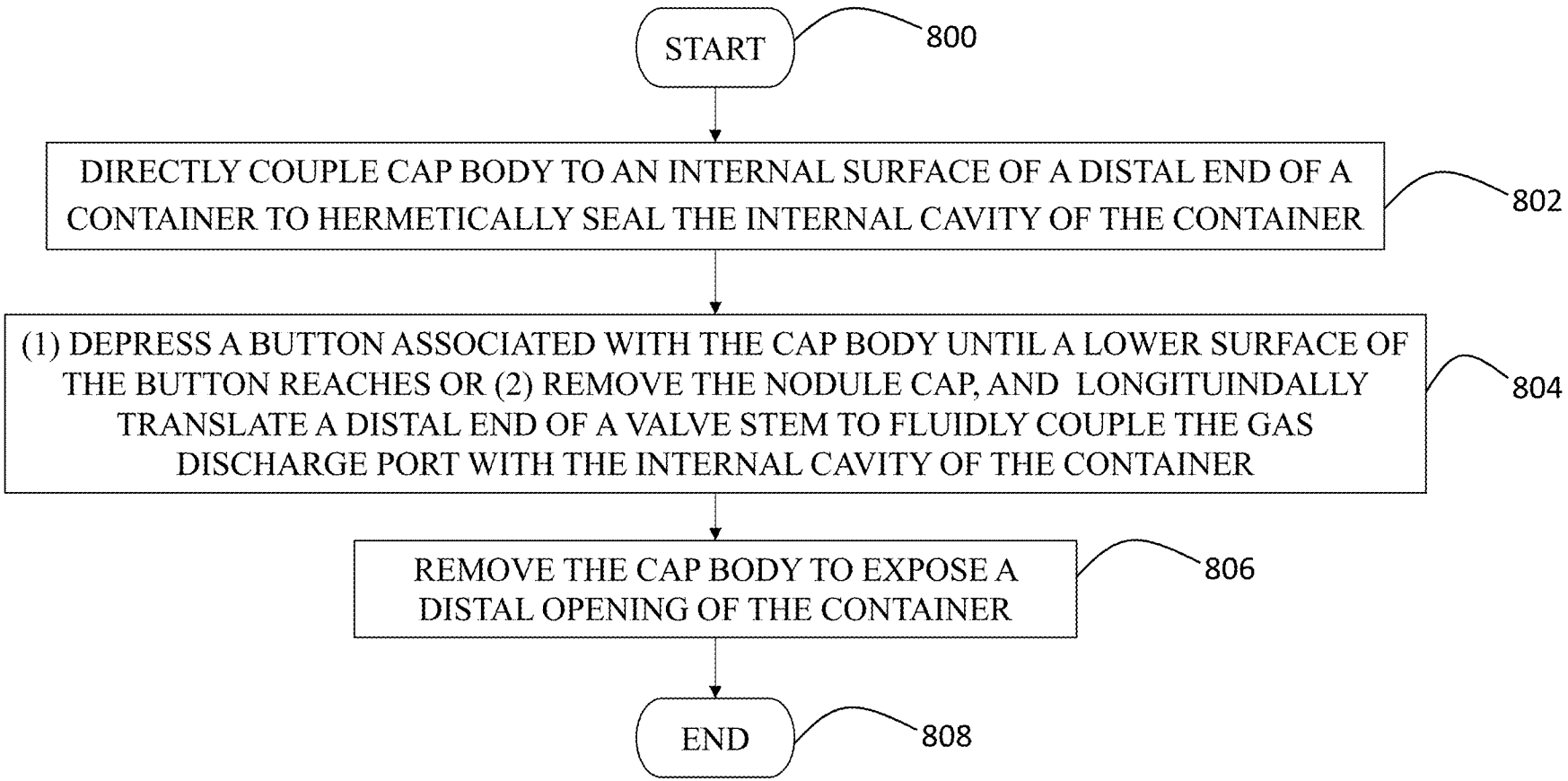
FIG. 8 is a process-flow diagram depicting a method of relieving gas within an internal cavity of a container in accordance with one embodiment of the present invention.

As discussed above, and with reference to the process-flow diagram depicted in FIG. 8 in conjunction with FIGS. 1-7 and 9-14, an exemplary method of relieving gas within an internal cavity of a container is illustrated. Specifically, the figures will be described in conjunction with the process flow chart of FIG. 8, and although FIG. 8 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 8 for the sake of brevity. In some embodiments, some or all of the process steps included in FIG. 8 can be combined into a single process.

The process begins at step 800 and immediately proceeds to step 802, which includes directly coupling an outer surface of a cap body to an internal surface of a distal end of the container (as depicted in FIGS. 1-2) to hermetically seal the internal cavity of the container from the ambient environment. As discussed above, the cap body may include a button/switch disposed thereon, a gas discharge port disposed above the distal end of the container where the cap body is coupled, and will define and enclose a cap channel with a valve assembly disposed therein. Otherwise, the cap body will include a nodule cover 500 operably configured to seat on and be removed from the cap body 102 to expose the stem displacement nodule 336. The valve assembly 312 may hermetically seal a portion of the cap channel with the internal cavity of the container, i.e., fluidly separate the internal cavity from the cap channel. In one embodiment, depending on the material of the cap body 102, e.g., cork or natural rubber, the cap body 102 will be operably configured to directly and deformably couple with the outer surface of said cap body to the internal surface the distal end of the container.

When the cap body 102 is coupled to the container 106, the valve assembly 312 may be in the "static" position along the stem translation path 208, wherein with the distal valve end 316 of a stem displacement nodule 336 is disposed proximal to, i.e., at or preferably near (within 1 inch), the lower surface 200 of the button 200 and/or nodule cover 500. In one embodiment the stem displacement nodule 336 will be formed as one piece with the stem 314, and may be of a substantially rigid (also referred to herein as "rigid") material, e.g., stainless steel, ceramic, or PVC, to effectuate transfer of force caused by the depression of the button 110. In other embodiments, the stem displacement nodule 336 may be coupled to an end of the valve stem 314 with friction fitting, adhesive, or other fastening means. In other embodiments, the stem displacement nodule 336 is preferably rounded or spherical to reduce the likelihood of jeopardizing the structural integrity of the button 110 and/or nodule cover 500. In the static position, the valve assembly 312 is in a hermetically sealed configuration with the cap body 102 to fluidly uncouple the first channel end 308 and the container cavity 112.

In embodiments of the invention utilizing the nodule cover 500 to prevent inadvertent depression of the stem displacement nodule 336, the user will remove a portion of the wrapper and the rigid nodule cover from the cap body to expose the first channel end of the cap channel and the distal end of the valve stem, e.g., the stem displacement nodule 336. As such, cover 500 may rest freely on the platform 1300 in a closed position (shown best in FIG. 14) and, when the user removes the wrapper, the user can place it in an open position (shown best in FIG. 15) in a cover translation path (represented in an exemplary path with lines 1302). Next, step 804 may include depressing and longitudinal translating the distal end of the longitudinally biased valve stem in a stem translation path to fluidly couple the first channel end, the container cavity, and the ambient environment, thereby discharging a gas housed within the container cavity. Thereafter, as part of step 806, a user may remove the muselet 600 and muselet cap 602, which may be collectively referred to as the "muselet," along with the cap body to expose a distal opening of the container defined by the distal end of the container for use.

When the user desires to use a version of the invention with the nodule cover replaced by the button, the user would remove the muselet and/or wrapper to expose the button. Then, the user would depres an upper surface of the button until a lower surface of the button reaches and longitudinal translates a distal end of a longitudinally biased valve stem in a stem translation path to fluidly couple the first channel, the container cavity, and the gas discharge port together, thereby discharging a gas housed within the container cavity. In one embodiment, the amount of force required to flex the button and/or move the nodule/valve stem nodule may be approximately 1-2 lbf to reduce the risk of inadvertent gas emission. Additionally, the depression of the upper surface of the button may be in a parallel, axial, and longitudinal direction opposite the biasing force direction (best represented by arrow 210 in FIG. 2) of the longitudinally biased valve stem. Said another way, the valve assembly may include a gas-evacuation position (best shown in FIG. 2) along the stem translation path with the button 110 in a depressed position and directly coupled to the distal valve end 316 to fluidly couple the first channel 308, the container cavity 112, and the gas discharge port 322. Another view of the valve assembly in the gas-evacuation position can be seen in FIG. 12.

Again, step 806 may now include safely and effectively removing the cap body to expose a distal opening of the container defined by the distal end of the container for use by the user. Beneficially, the cap body 102 may be reusable with the container or other containers, thereby providing an effective and efficient solution to reducing safety risks associated with internal pressure build-up. The process may then terminate at step 808.

Figure 16:
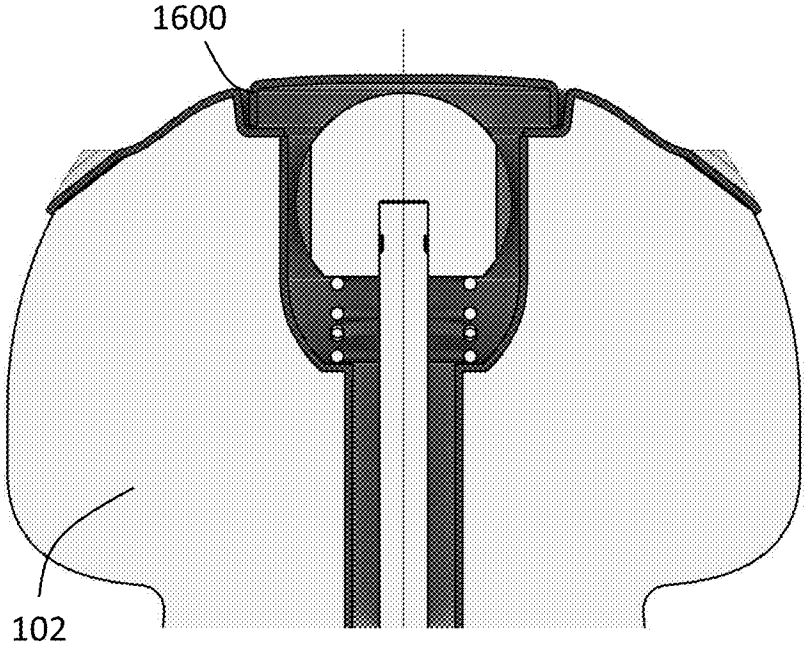
FIGS. 15-16 depict fragmentary cross-sectional views of exemplary pressure-reducing bottle covers in accordance with embodiments of the present invention.
Figure 15:
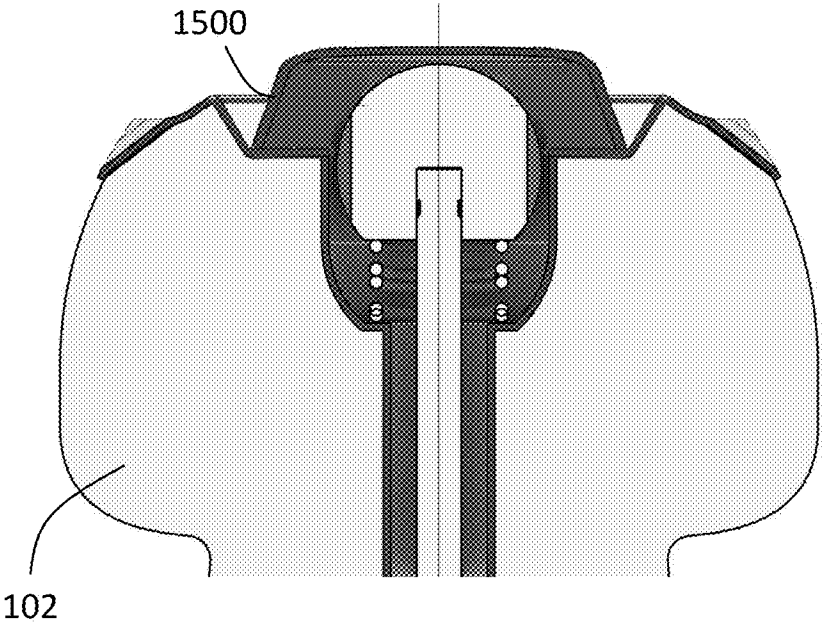

With reference to FIGS. 15-16, fragmentary cross-sectional views of exemplary pressure-reducing bottle covers in accordance with embodiments of the present invention. Specifically, exemplary rigid nodule covers 1500, 1600 are depicted disposed within the muselet cap aperture and selectively removably coupled to the cap body 102. As depicted in FIGS. 15-16, the rigid nodule covers 1500, 1600 may be of a substantially flush height with the surrounding terminal end of the cap body 102 or raised above the surrounding terminal end of the cap body 102.

A pressure-reducing bottle cover has been disclosed that includes a cap or cover body that is operably configured to safely and effectively discharge accumulated gas within a container that the cap is coupled to before the cover or cap is removed by the user.

What is claimed is:

1. A cap in combination with a portable and hand-held container having a bottom wall, sidewalls, a container cavity defined by the bottom wall and sidewalls, and a distal end defining a distal opening in fluid communication with the container cavity, wherein an improvement comprises:

a cap body removably coupled to the distal end of the container in a hermetically sealed configuration with a wrapper and a muselet retaining a muselet cap, defining a muselet cap aperture, coupled to the cap body, the cap body having:

a first terminal end and a second end opposite the first terminal end of the cap body;

a rigid nodule cover disposed within the muselet cap aperture and selectively removably coupled to the first terminal end of the cap body; and a cap channel defined and surrounded by the cap body, the cap channel having a first channel end disposed at the first terminal end of the cap body and a second channel end opposing the first channel end; and a valve assembly disposed within the cap channel and having a valve stem with a distal valve end and a spring operably configured to bias the valve stem in a direction toward the nodule cover, the valve stem having:

a static position along a stem translation path with the wrapper superimposing a portion of the cap body, the muselet cap aperture, and the rigid nodule cover and with the valve assembly in hermetically sealed configuration with the cap body to fluidly uncouple the first channel end and the container cavity; and a gas-evacuation position along the stem translation path with the nodule cover selectively uncoupled from the cap body and with the distal valve end in a depressed position to fluidly couple the first channel end, the container cavity, and an ambient environment.

2. The improvement according to claim 1, wherein the cap body further comprises:

a cap length spanning from the first terminal end of the cap body to the second end of the cap body.

3. The improvement according to claim 2, wherein the cap body further comprises:

a recess defined by the first terminal end and includes a platform supporting the nodule cover when the valve stem is in the static position along the stem translation path.

4. The improvement according to claim 3, further comprising:

the wrapper removably coupled to and surrounding the muselet, the muselet cap, the cap body, and the nodule cover, wherein the wrapper includes a removed position along a wrapper removal path with the recess defined by the first terminal end of the cap body and the muselet cap aperture are shaped and sized to permit entry and egress of the nodule cover through the recess and the cap aperture.

5. The improvement according to claim 4, wherein:

the nodule cover includes an indentation defined thereon.

6. The improvement according to claim 1, wherein the valve assembly further comprises:

a valve shoulder disposed at an end of the valve stem and having an outer surface, the outer surface of the valve shoulder seated in a hermetically sealed configuration with a second end of the cap body, opposing a first end of the cap body, when the valve stem is in the static position along the stem translation path.

7. The improvement according to claim 6, wherein the valve shoulder further comprises:

a first diameter greater in length than a diameter of the second channel end;

a second diameter less in length than the diameter of the second channel end; and a shoulder length separating the first and second diameters, the valve shoulder of a uniform tapered width spanning the shoulder length.

8. The improvement according to claim 6, wherein:

the valve shoulder and the second end of the cap body are of a conical shape conforming to one another.

9. The improvement according to claim 1, further comprising:

the wrapper removably coupled to and surrounding the muselet, the muselet cap, the cap body, and the nodule cover, wherein a portion of the wrapper is coupled to a portion of the rigid nodule cover though a fastener.

10. A cap in combination with a portable and hand-held container having a bottom wall, sidewalls, a container cavity defined by the bottom wall and sidewalls, and a distal end defining a distal opening in fluid communication with the container cavity, wherein an improvement comprises:

a cap body removably coupled to the distal end of the container in a hermetically sealed configuration and having:

a wrapper and a muselet retaining a muselet cap coupled to the cap body;

a first terminal end and a second end opposite the first terminal end of the cap body;

a button disposed on the first terminal end of the first terminal end of the cap body and having a lower surface;

a cap channel defined and surrounded by the cap body, the cap channel having a first channel end disposed at the first terminal end of the cap body and a second channel end opposing the first channel end; and a gas discharge port defined on an outer surface of the cap body and in fluid communication with the first channel end; and a valve assembly disposed within the cap channel and having a valve stem with a distal valve end and a spring operably configured to bias the valve stem in a direction toward the lower surface of the button, the valve stem having:

a static position along a stem translation path with the distal valve end disposed proximal to the lower surface of the button, the wrapper superimposing a portion of the cap body, the muselet, the muselet cap, and the button, and with the valve assembly in hermetically sealed configuration with the cap body to fluidly uncouple the first channel end and the container cavity; and a gas-evacuation position along the stem translation path with the button in a depressed position directly coupled to the distal valve end to fluidly couple the first channel, the container cavity, and the gas discharge port.

11. The improvement according to claim 10, wherein the cap body further comprises:

a cap length spanning from the first end of the cap body to the second end of the cap body.

12. The improvement according to claim 11, wherein the valve assembly further comprises:

a valve shoulder disposed at an end of the valve stem and having an outer surface, the outer surface of the valve shoulder seated in a hermetically sealed configuration with the second end of the cap body when the valve stem is in the static position along the stem translation path.

13. The improvement according to claim 12, wherein the valve shoulder further comprises:

a first diameter greater in length than a diameter of the second channel end;

a second diameter less in length than the diameter of the second channel end; and a shoulder length separating the first and second diameters, the valve shoulder of a uniform tapered width spanning the shoulder length.

14. The pressure-reducing bottle cover according to claim 12, wherein:

the button is of a deformably flexible material and defines a perimeter recess surrounding the button.

15. A method of relieving gas within an internal cavity of a container, the method comprising:

providing a container with a cap body directly coupled, through an outer surface of the cap body, to an internal surface of a distal end of the container to hermetically seal an internal cavity of the container from an ambient environment, the cap body defining and enclosing a cap channel with a valve assembly, including a longitudinally biased valve stem with a distal end, disposed therein and hermetically sealing a first channel end of the cap channel with an internal cavity of the container;

providing rigid nodule cover selectively removably coupled to the cap body and superimposing the first channel end of the cap channel;

providing a muselet, having a muselet cap defining a muselet cap aperture, and a wrapper superimposing a portion of the cap body, the muselet cap aperture, and the rigid nodule cover;

removing a portion of the wrapper and the rigid nodule cover from the cap body to expose the first channel end of the cap channel and the distal end of the valve stem;

depressing and longitudinal translating the distal end of the longitudinally biased valve stem in a stem translation path to fluidly couple the first channel end, the container cavity, and the ambient environment, thereby discharging a gas housed within the container cavity; and removing the cap body to expose a distal opening of the container defined by the distal end of the container.

16. The method according to claim 15, further comprising:

providing a portion of the wrapper coupled to a portion of the rigid nodule cover though a fastener; and removing the portion of the wrapper and the rigid nodule cover from the cap body simultaneously.

17. The method according to claim 15, wherein the cap body further comprises:

a recess defined by a first terminal end and includes a platform supporting the nodule cover.

* * * * *